US007077545B2

(12) United States Patent
Levin

(10) Patent No.: US 7,077,545 B2
(45) Date of Patent: Jul. 18, 2006

(54) WEATHER RESISTANT LIGHTING FIXTURE SHELTER METHOD AND APPARATUS

(76) Inventor: Bruce C. Levin, 774 Holmby Ave., Los Angeles, CA (US) 90024

( * ) Notice: Subject to any disclaimer, the term of this patent is extended or adjusted under 35 U.S.C. 154(b) by 156 days.

(21) Appl. No.: 10/834,057

(22) Filed: Apr. 29, 2004

(65) Prior Publication Data

US 2005/0243562 A1 Nov. 3, 2005

(51) Int. Cl.
*F21V 29/00* (2006.01)

(52) U.S. Cl. ..... 362/294; 362/373; 362/277; 362/353

(58) Field of Classification Search ..... None
See application file for complete search history.

(56) References Cited

U.S. PATENT DOCUMENTS 3,310,672 A * 3/1967 Bursell ..... 362/364
5,599,091 A * 2/1997 Kira ..... 362/269
5,651,606 A * 7/1997 Krogman ..... 362/96
6,152,578 A * 11/2000 Hoffman et al. ..... 362/285
6,206,546 B1 * 3/2001 Krogman ..... 362/267

* cited by examiner

*Primary Examiner*—Renee Luebke
*Assistant Examiner*—Julie Shallenberger
(74) *Attorney, Agent, or Firm*—Berenato, White & Stavish LLC

(57) ABSTRACT

The weather-resistant shelter for a lighting fixture is primarily designed for use in outdoor environments. The shelter comprises upper and lower hood segments attached to a backing plate. A horizontal gap between the hood segments allows cooling air to circulate around electrical components within the shelter while protecting the electrical components from moisture. A second embodiment comprises a backing plate sized and dimensioned to house certain electrical components. In an additional embodiment, the backing plate is divided into independent upper and lower halves for increased flexibility. The device may be specifically configured to accommodate a bulb of 60 watts or more.

19 Claims, 6 Drawing Sheets

11
12
18
14
17
13
10
15
16

WEATHER RESISTANT LIGHTING FIXTURE SHELTER METHOD AND APPARATUS

BACKGROUND OF THE INVENTION

1. Field of the Invention

The invention generally relates to weather resistant shelters that reside inside wall-mounted lighting fixtures; more specifically, the invention applies to weather resistant shelters for lighting fixtures that include electrical components exposed to moisture.

2. Description of the Background Art

Outdoor light fixtures are exposed to the environment due to their usage. Therefore, such fixtures are generally constructed to withstand moisture, such as dew, rain, or water above the light fixture. The construction of a shelter to protect the electrical components of an outdoor light fixture generally consist of a partially closed shelter, open at one end. The housing holds a lamp bulb which shines light onto an illuminated structure or area. While various available light structures are sealed to keep water from entering, and do so adequately, they have other drawbacks.

The background art includes multiple varieties of outdoor lighting shelters designed to protect exposed electrical components from direct contact with moisture. However, prior art lighting shelters frequently include lighting fixtures that either generally enclose the light bulb to the extent that they prevent sufficient cooling of higher wattage light bulbs, are visually obtrusive when viewing the outside of a decorative lighting fixture, or those shelters that unnecessarily expose the electrical components to contact with rain or moisture.

SUMMARY OF THE INVENTION

It is therefore an object of the invention to provide a lighting fixture or shelter that sufficiently protects at least one electrical component from moisture and other typical outdoor weather conditions, while at the same time providing sufficient air flow to cool the electrical component(s) in a manner that does not degrade the life or lighting capability of the electrical component(s).

For purposes of this invention, the term "electrical component(s)" is intended to encompass all components that carry or house devices that carry electricity; for example, at least one light bulb; at least one socket; wiring, and electrical connections. For fluorescent lighting fixtures, the term "electrical components" would include the ballast.

Additionally, the invention provides a lighting fixture and/or shelter that may specifically be used with a light bulb of more than 60 watts. The shelter of the present invention is designed to allow sufficient cooling of a higher wattage bulb, such that the lighting and useful life of the bulb are not degraded.

In satisfaction of the foregoing objects and advantages, the present invention provides an outdoor lighting fixture or shelter comprised of a backing plate connected to a multi-section hood which may be opaque, transparent, frosted and/or translucent. The hood has an upper and lower section with a vent space between the segments to allow air to circulate around the electrical components enclosed by the hood.

In a first embodiment, the upper and lower hood segments are attached to a backing plate. The backing plate and hoods may be made of any suitable material (e.g., metal, plastic, polycarbonate, glass, etc.) and may be frosted, clear and/or colored as would be understood by those of skill in the art.

Further, the backing plate may be sized and dimensioned to hide or house wiring associated with the lighting fixture or shelter. The hood upper and lower segments overlap with a gap there between. The lower hood is preferably inset relative to the upper hood, and thereby creates a vent for air to enter and exit, thereby cooling the sheltered electrical components while keeping moisture from contacting the electrical components.

In a second embodiment, the upper and lower hood segments are similarly disposed, however, the hood segments are connected to two separate backing plates, allowing the user to more conveniently move the two hood segments closer or further apart, as required by a particular application. Likewise, multiple hoods may be provided with one or more backing plates as will be described below.

Other modifications are also envisioned by this invention. For example, this invention should not be limited to two hood segments and/or backing plates; instead, this invention may encompass any number of hood segments and/or backing plates to provide a desired number of vents in accordance with the principles of this invention while protecting the electrical components from moisture.

BRIEF DESCRIPTION OF THE DRAWINGS

The above and other objects, advantages, and novel features of the present invention will become apparent from the following detailed description of the invention illustrated in the accompanying drawings, wherein.

DETAILED DESCRIPTION OF THE INVENTION

The following detailed description of the present invention is directed to a device to adequately shelter a relatively high wattage light bulb from moisture and other typical outdoor weather conditions, while simultaneously allowing sufficient cooling of the electrical components to prevent the degradation of the electrical components' useful life and lighting capability and/or the degradation of the shelter material. Additionally, the present invention adheres to and meets Underwriters Laboratories (UL) standards and is currently listed by UL as suitable for wet locations.

Figure 2:
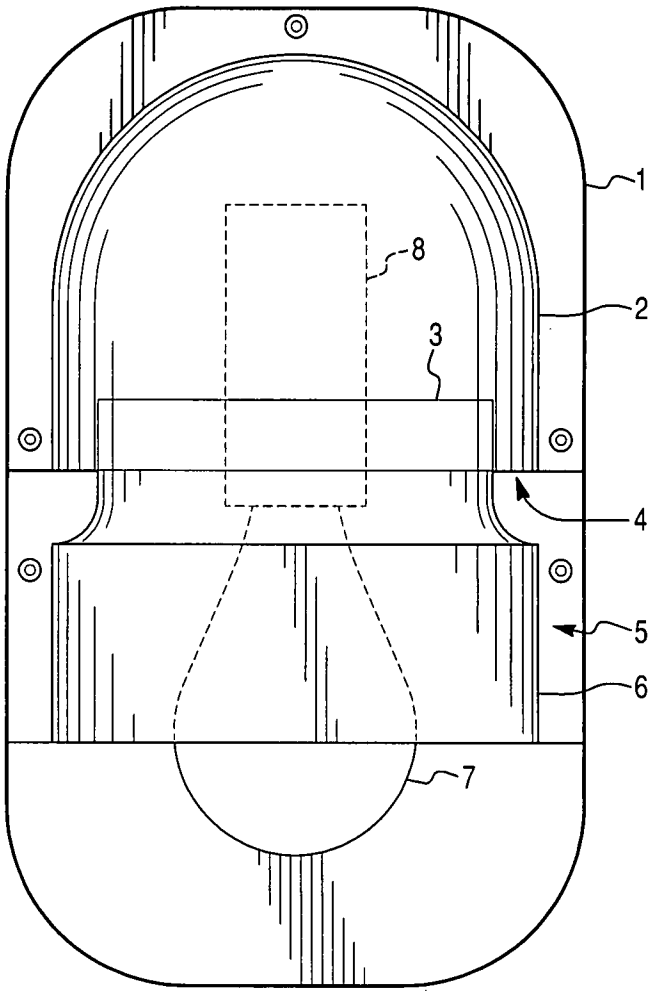
FIG. 2 is a front view of the embodiment in FIG. 1.
Figure 1:
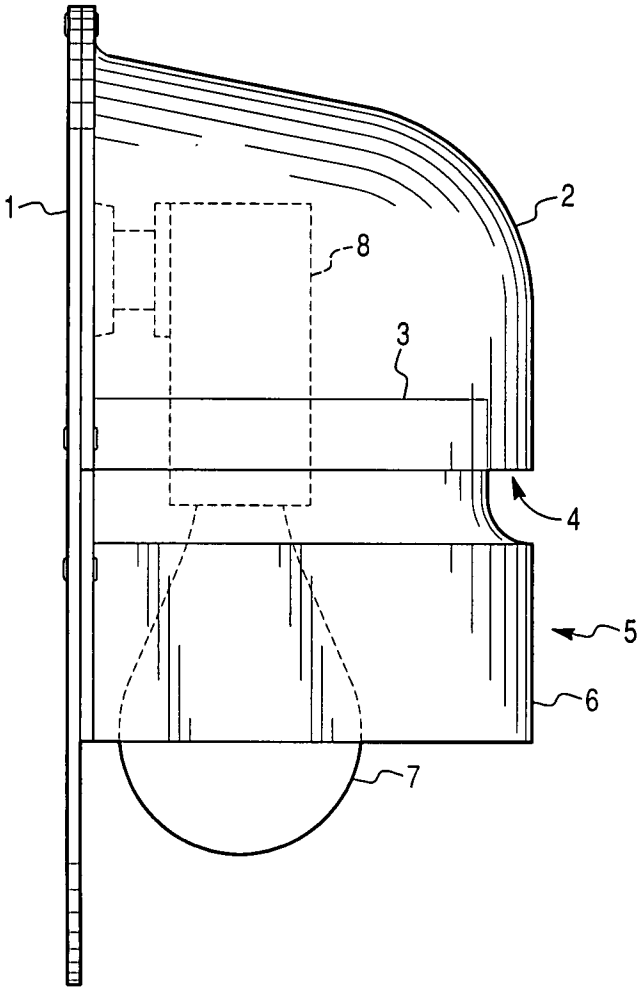
FIG. 1 is a profile view of the first embodiment.

Referring to FIGS. 1 and 2, one possible embodiment of the invention comprises a backing plate 1 attached to an upper hood 2, having a generally downwardly curving shape. The backing plate 1 is similarly attached to a lower hood 5. The lower hood 5 is comprised of a first segment 3, with a smaller radius, and a second segment 6, with a radius approximately equal to the radius of the upper hood 2, the first segment 3, being connected to the second segment 6, by an upward sloping section of the lower hood 5. A vent area 4 is formed by the gap between the upper hood 2, and the first segment 3 of the lower hood 5, through which air passes to cool the light bulb 7 and socket 8 and other electrical components.

Figure 3:
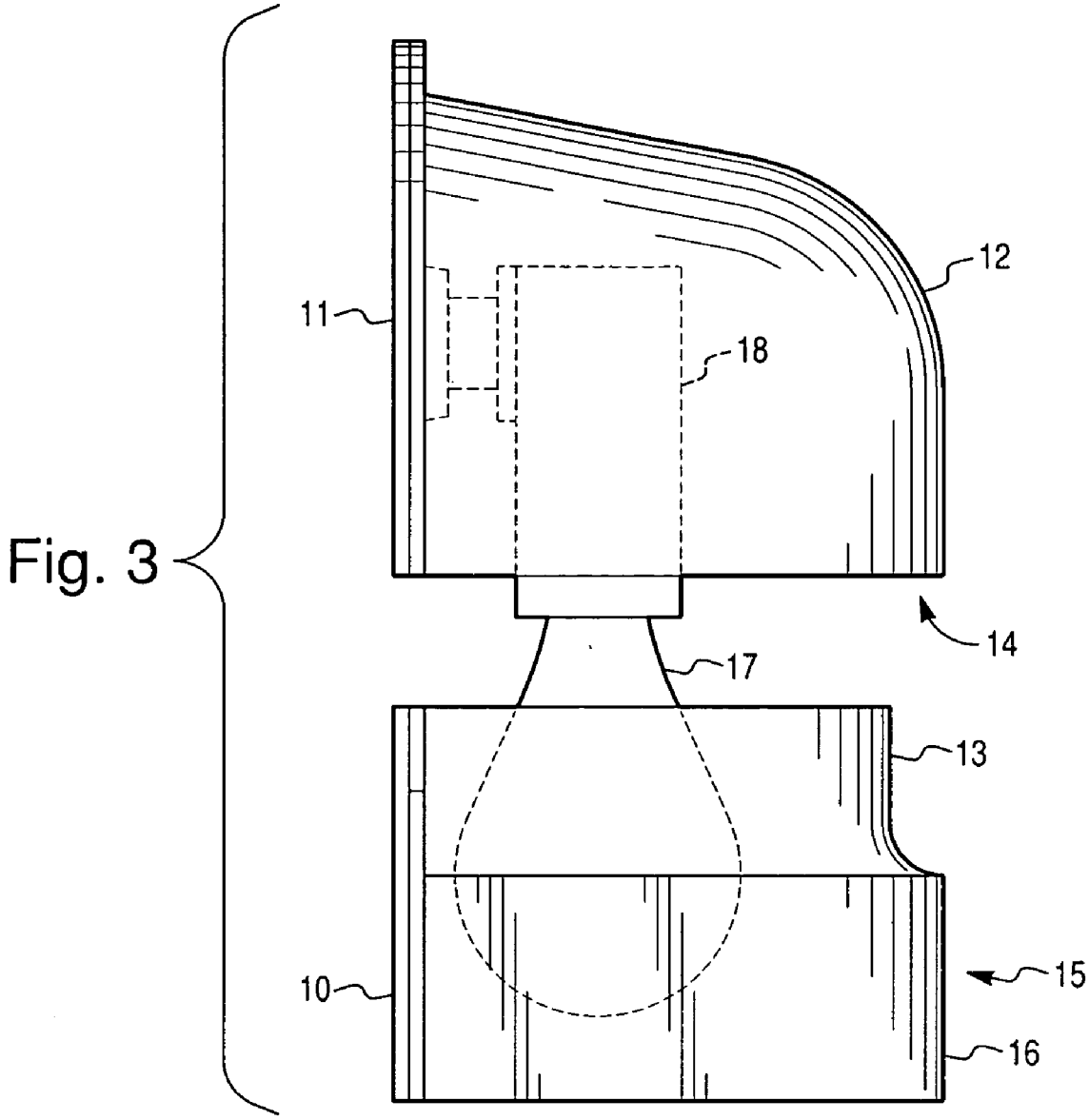
FIG. 3 is a profile view of the second embodiment.
Figure 4:
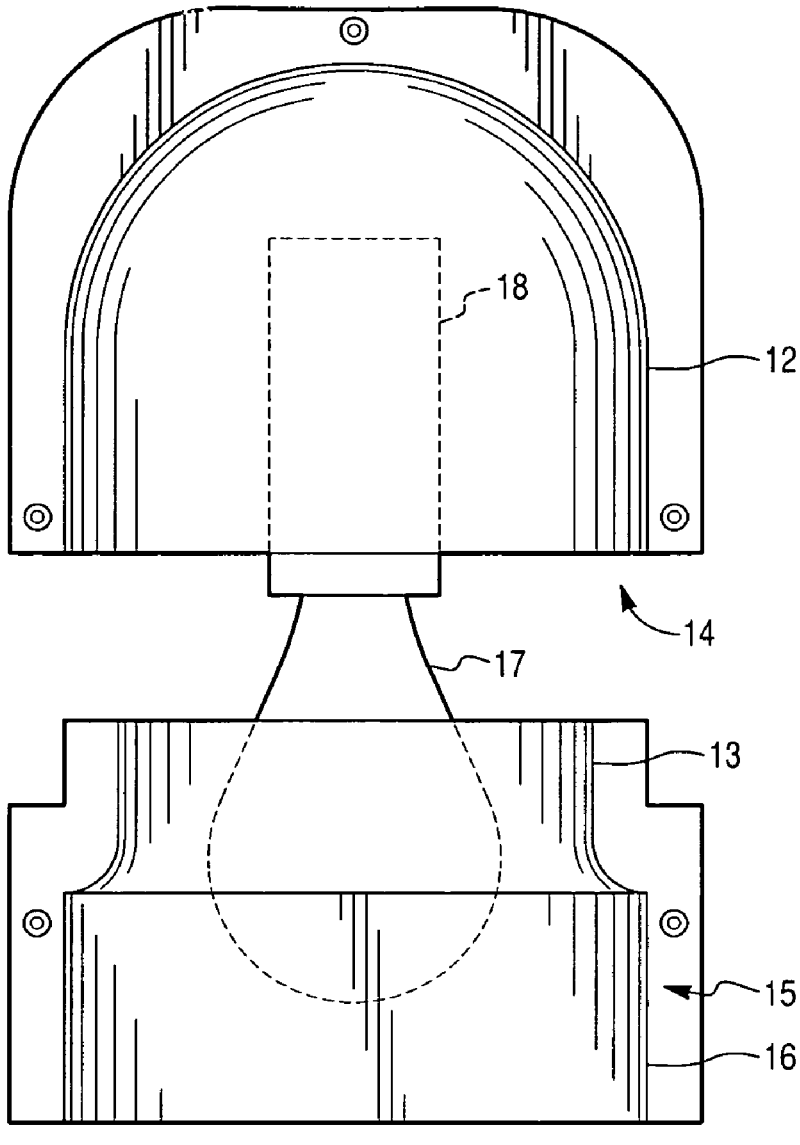
FIG. 4 is a front view of the embodiment in FIG. 3.
Figure 5:
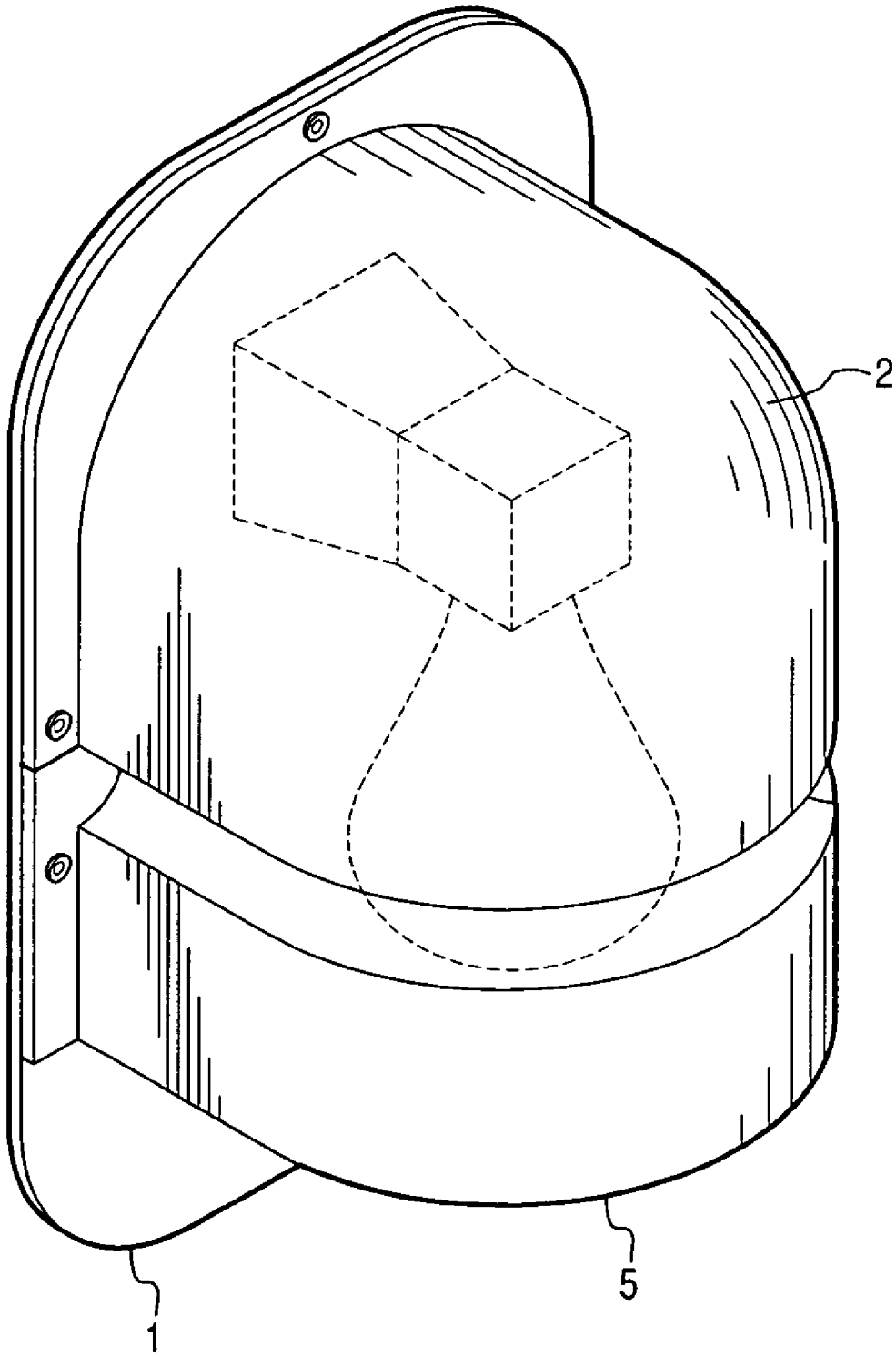
FIG. 5 is a front and top side perspective view of the embodiment of FIG. 1.

FIGS. 3 and 4, disclose a second possible embodiment. The second embodiment permits the upper and lower segments to be moved, as required, to accommodate particular bulb sizes with corresponding cooling requirements, and to customize a specific lighting configuration to address specific lighting requirements. The second embodiment comprises upper 11, and lower 10 backing plates. The upper backing plate 11 is attached to an upper hood 12, having a generally downwardly curving shape. The lower backing plate 10 is similarly attached to a lower hood 15. The lower hood 15 is comprised of a first segment 13, with a smaller radius, and a second segment 16, with a radius approximately equal to the radius of the upper hood 12, the first segment 13, being connected to the second segment 16, by an upward sloping section of the lower hood 15. A vent area 14 is formed by the gap between the upper hood 12, and the first segment 13 of the lower hood 15, through which air passes to cool the light bulb 17 and socket 18 assembly enclosed by the fixture.

For the foregoing reasons, it is clear that the invention provides a shelter that sufficiently protects electrical components (e.g. light bulb, socket, wiring, electrical connections, etc.) such that the electrical components are protected from moisture and other typical outdoor weather conditions, while at the same time providing sufficient air flow to cool the electrical components in a manner that does not degrade the life or lighting capability of the electrical components and the shelter itself. More specifically, the invention provides a shelter and lighting fixture that may specifically be used, for example, with a light bulb of more than 60 watts, in a lighting environment with moisture.

While the invention has been shown with curved first segments 3, 13 and curved upper portions 2, 12, it will be understood by those of skill in the art that the particular shapes and dimensions are provided only by way of example and are not intended to limit the scope of this invention. For example, the upper hood 2, 12 may be formed with any shape but preferably is formed to permit moisture to easily flow away from the electrical components.

Although the scale of the invention may be varied to suit numerous applications, the dimensions in some specific applications may be important. However, this invention should not be limited to specific dimensions not expressed in the claims. In one specific embodiment, the device may be designed for use with a 100-watt light bulb 7, 17. In this specific application, the curvature and shape of the top of the metal backing plate 1, 11, may be parallel to the shape of the upper hood 2, 12, and the upper and lower hoods may be connected to the backing plate with any suitable mechanical means (e.g., metal rivets, adhesive, screws, bolts, etc), and/or sealed with a sealant (e.g. a silicone sealant).

In an alternative embodiment, the inside back of the lighting fixture acts as a backing plate, with the hoods attaching directly to the fixture. In another alternative embodiment, the hoods and backing plate are integrated and composed of one material (e.g., all components are integrated into a single piece of injection molded plastic) with sufficient cooling apertures provided to cool the electrical components, while protecting the electrical components from moisture.

The invention, as described, may be applied in various applications and modified in multiple ways. For example, the bottom surface of the lower hood 5, 15, may be covered and effectively enclose the bottom half of the device, or it may have one or more apertures, as required, to facilitate cooling of the enclosed light bulb. Similarly, although the materials of construction are generally described as metal, plastic, polycarbonate, glass, etc., they may also include a variety of compositions consistent with the function of the invention. Moreover, the number of segments is not limited to those designs shown and described in this specification; rather, more than two segments may be used to provide any number of vent areas in accordance with the principles of this invention. Such variations are not to be regarded as a departure from the spirit of the invention, and all such modifications as would be obvious to one skilled in the art are intended to be included within the scope of the following claims.

Figure 6:
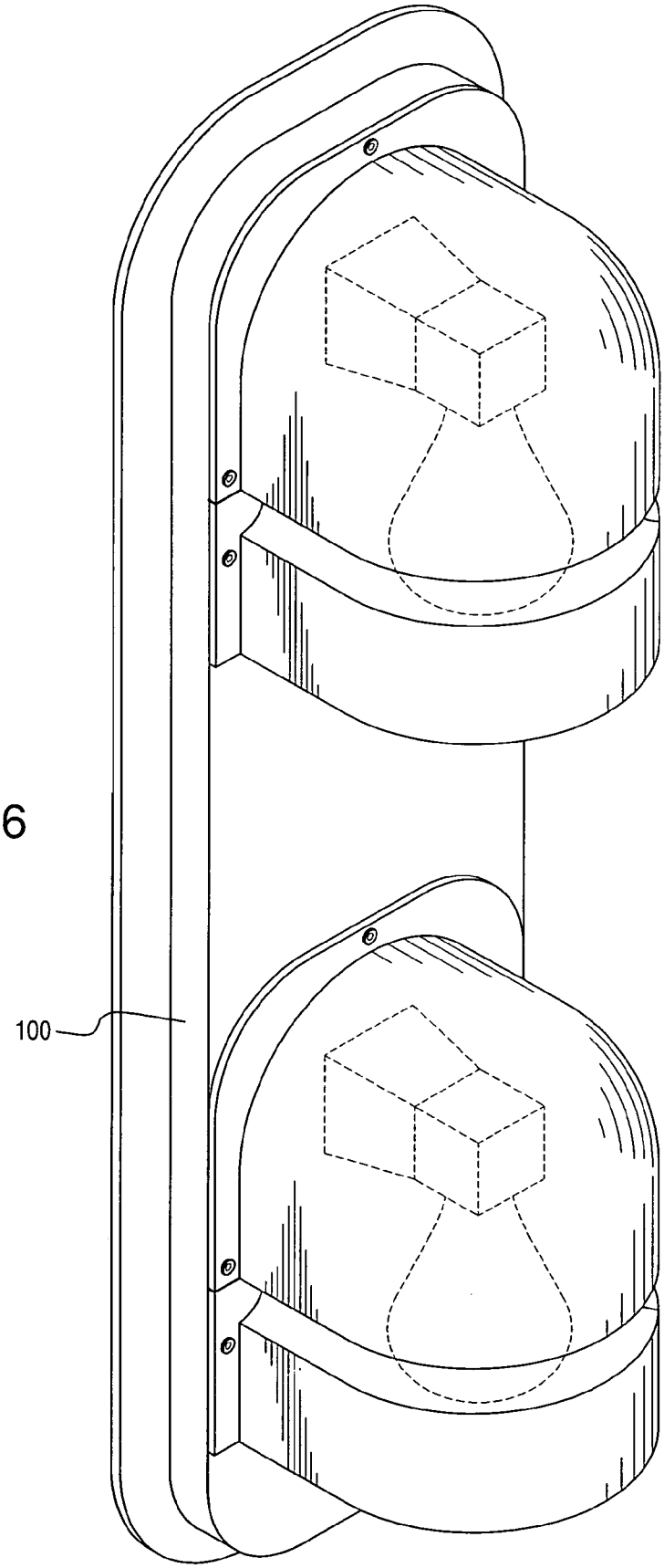
FIG. 6 is a front and top side perspective view of a further embodiment where two shelter assemblies are disposed adjacent to one another and the backing plate is sized and dimensioned to hide wiring associated with the light fixture or shelter.
Figure 7:
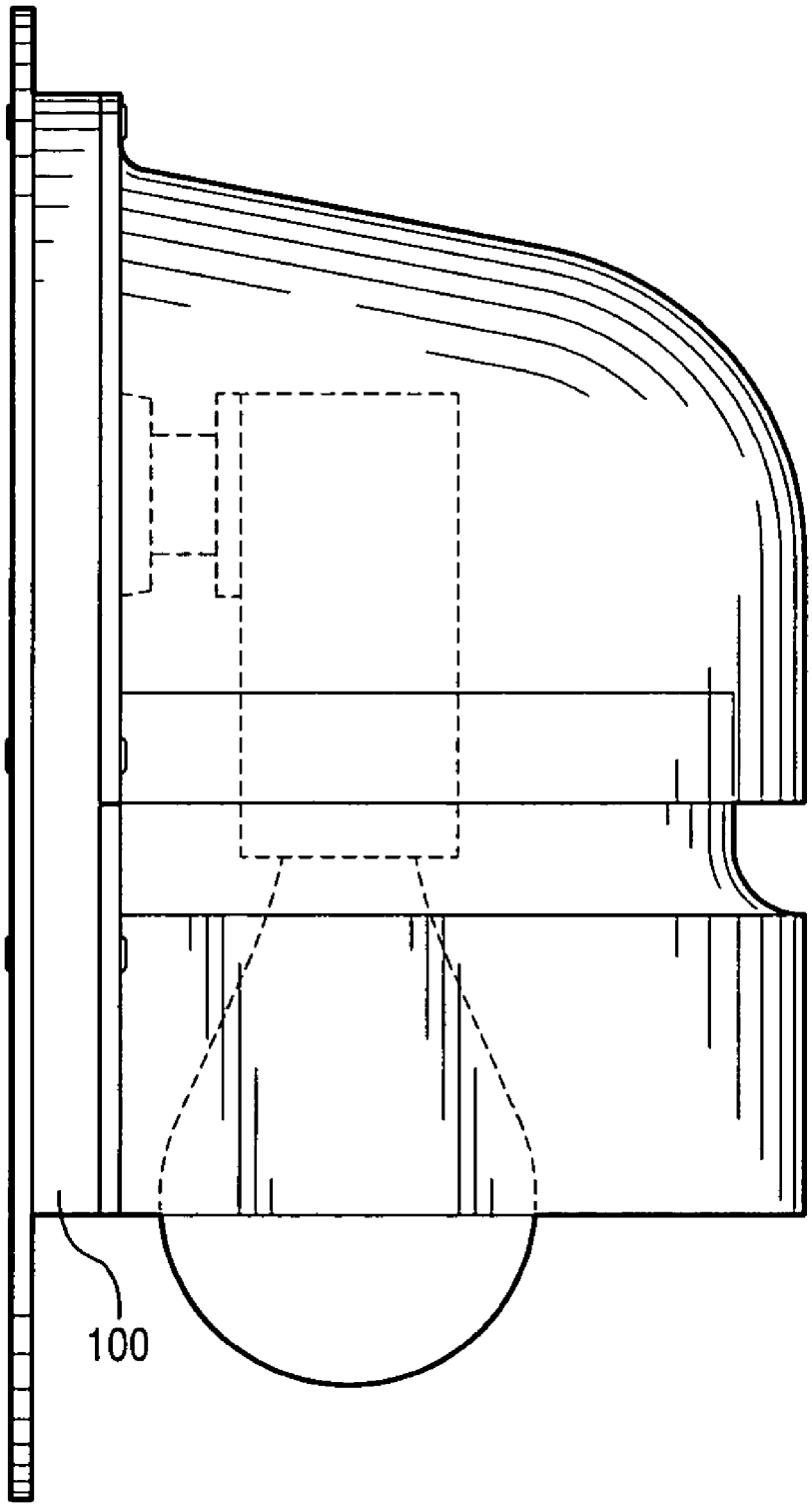
FIG. 7 shows yet another embodiment where a single includes a backing plate that is sized and dimensioned to hide wiring associated with the light fixture or shelter.

Moreover, the number of hoods attached to the backing plate may vary in accordance with the environment and lighting requirements. As shown in FIG. 6, more than one shelter assembly may be attached in a stacked manner to a single backing plate. In addition, the backing plate 100 may be sized and dimensioned to hide or house wiring associated with the lighting fixture or shelter in the manner shown in FIGS. 6 and 7.

I claim:

1. A shelter to protect electrical components of a lighting fixture comprising:

at least one electrical component;

at least one vertical backing plate adapted to be disposed along one vertical side wall;

a first hood attached to said at least one vertical backing plate, said first hood having a generally downwardly sloping shape that extends parallel to said at least one vertical backing plate;

a second hood attached to said at least one vertical backing plate, said second hood comprising a first segment and a second segment extending parallel to said at least one vertical backing plate, said first segment partially overlapping and received within said first hood;

said first hood forming a horizontal gap between said first hood and said first segment of said second hood, such that air can circulate through said gap.

2. The shelter described in claim 1, wherein said second segment of said second hood has a radius substantially equal to a radius of said first hood.

3. The shelter described in claim 1, wherein said first segment of said second hood is connected to said second segment of said second hood, by an upward sloping section of said second hood.

4. The shelter as described in claim 1, wherein said first and second hoods are comprised of at least one of a translucent, transparent, and opaque material.

5. The shelter as described in claim 1, wherein said backing plate is metal, an upper portion of said backing plate having an arcuate shape that is parallel to the shape of said first hood.

6. The shelter as described in claim 1, wherein said backing plate is sized and dimensioned to enclose some electrical components associated with said lighting fixture.

7. The apparatus as described in claim 1, wherein said first and second hoods are sealed to said at least one backing plate by silicone sealant.

8. The apparatus as described in claim 1, wherein said shelter is adapted to receive a light bulb that is rated at more than 60 watts.

9. The apparatus as described in claim 1, wherein said backing plate and said first and second hoods are collectively formed of a single piece of molded plastic.

10. The apparatus as described in claim 1, wherein said backing plate is formed as part of said electrical component such that said first and second hoods are attached to said electrical component.

11. A shelter to protect electrical components of a lighting fixture comprising:

at least one electrical component;

at least one backing plate;

a first hood attached to said backing plate, said first hood having a generally downwardly sloping shape;

a second hood attached to said at least one backing plate, said second hood comprising a first and second segment, said first segment partially overlapping and received within said first hood;

said first hood forming a horizontal gap between said first hood and said first segment of said second hood, such that air can circulate through said gap, wherein said at least one backing plate is separated into independently movable first and second backing plate sections, said first and second backing plate sections being movable to customize said fixture, as required by specific cooling and lighting applications.

12. The apparatus as described in claim 11, wherein said first hood is attached to said first backing plate section, and said second hood is attached to said second backing plate section.

13. The apparatus as described in claim 11, wherein said first and second backing plate sections are metal, an upper portion of said first backing plate section having an arcuate shape that is parallel to the shape of said first hood.

14. The apparatus as described in claim 11, wherein said first and second hoods are sealed to said first and second backing plate sections by silicone sealant.

15. The apparatus as described in claim 12, wherein said shelter is adapted to receive a light bulb that is rated at more than 60 watts.

16. A method of sheltering a light fixture from moisture comprising:

attaching at least one first hood to at least one vertical backing plate, said first hood having a generally downwardly curving shape that extends parallel to said at least one vertical backing plate;

attaching at least one second hood to said at least one vertical backing plate, said second hood comprising a first segment that overlaps with and is received within said first hood, said first segment extending parallel to said at least one vertical backing plate, wherein a horizontal gap is provided between said first hood and said first segment of said second hood;

allowing air to pass through said gap to cool electrical components that are at least partially enclosed by said fixture.

17. The method as described in claim 16, wherein said first and second hoods are comprised of at least one of a translucent, transparent, and opaque material.

18. The method as described in claim 16, wherein said at least one backing plate is separated into independently movable first and second backing plate sections, said first and second backing plate sections are movable to customize said fixture, as required by specific cooling and lighting applications.

19. The method as described in claim 16, further comprising the step of sealing said first and second hoods to said first and second backing plate sections.

* * * * *